US009131747B2

(12) United States Patent
Yang

(10) Patent No.: US 9,131,747 B2
(45) Date of Patent: Sep. 15, 2015

(54) SHOE SOLE

(76) Inventor: Cheol Ho Yang, Busan (KR)

( * ) Notice: Subject to any disclaimer, the term of this patent is extended or adjusted under 35 U.S.C. 154(b) by 448 days.

(21) Appl. No.: 13/807,172

(22) PCT Filed: Nov. 1, 2010

(86) PCT No.: PCT/KR2010/007592

§ 371 (c)(1),
(2), (4) Date: Dec. 27, 2012

(87) PCT Pub. No.: WO2012/002621

PCT Pub. Date: Jan. 5, 2012

(65) Prior Publication Data

US 2013/0091739 A1 Apr. 18, 2013

(30) Foreign Application Priority Data

Jun. 29, 2010 (KR) ..... 10-2010-0061734

(51) Int. Cl.

| | |
|---|---|
| ***A43B 13/18*** | (2006.01) |
| ***A43B 13/14*** | (2006.01) |
| ***A43B 13/12*** | (2006.01) |
| ***A43B 7/14*** | (2006.01) |
| ***A43B 23/22*** | (2006.01) |
| ***A43B 7/24*** | (2006.01) |
| ***A43B 13/02*** | (2006.01) |

(52) U.S. Cl.

CPC . *A43B 13/14* (2013.01); *A43B 7/14* (2013.01); *A43B 7/1415* (2013.01); *A43B 7/24* (2013.01); *A43B 13/02* (2013.01); *A43B 13/12* (2013.01); *A43B 13/125* (2013.01);

(Continued)

(58) Field of Classification Search

CPC ..... A43B 7/141; A43B 7/1415; A43B 7/24; A43B 7/14; A43B 7/143; A43B 7/1145; A43B 7/145; A43B 7/144; A43B 13/188; A43B 13/14; A43B 13/125; A43B 13/127

USPC ..... 36/25 R, 30 R, 140, 142–144

See application file for complete search history.

(56) References Cited

U.S. PATENT DOCUMENTS 4,730,402 A 3/1988 Norton et al.
4,882,856 A * 11/1989 Glancy ..... 36/43

(Continued)

FOREIGN PATENT DOCUMENTS

| | | |
|---|---|---|
| JP | 2006-549 | 1/2006 |
| KR | 10-0914176 | 8/2009 |

(Continued)

OTHER PUBLICATIONS

International Search Report issued Jul. 28, 2011 in International (PCT) Application No. PCT/KR2010/007592.

*Primary Examiner* — Ted Kavanaugh

(74) *Attorney, Agent, or Firm* — Wenderoth, Lind & Ponack, L.L.P.

(57) ABSTRACT

A shoe sole which assists in and enables correct walking. The shoe sole includes an outsole, a main midsole, a lower midsole and an upper midsole. The main midsole includes an inclined slope, a first extending section which is connected to the lower end of the slope, and a second extending section which is connected to the upper end of the slope. The first extending section is coupled to the outsole from a periphery of either an inward side or an outward side of an upper surface of the outsole. The lower midsole is disposed between undersurfaces of the slope and the second extending section and the upper surface of the outside. The upper midsole is coupled to upper surfaces of the slope and the first extending section.

6 Claims, 3 Drawing Sheets

(52) U.S. Cl.
CPC ..... *A43B 13/127* (2013.01); *A43B 13/188* (2013.01); *A43B 23/22* (2013.01)

(56) References Cited

U.S. PATENT DOCUMENTS 4,890,397 A * 1/1990 Harada et al. ..... 36/30 R
6,023,861 A * 2/2000 Bizzotto ..... 36/179
6,115,944 A 9/2000 Lain
6,604,301 B1 * 8/2003 Manoli et al. ..... 36/43
6,725,578 B2 * 4/2004 Kerrigan ..... 36/144
2007/0163150 A1 * 7/2007 Yang ..... 36/108

FOREIGN PATENT DOCUMENTS

KR 10-2009-0113473 11/2009
KR 10-2010-0051210 5/2010

* cited by examiner

SHOE SOLE

TECHNICAL FIELD

The present invention relates, in general, to a technology relating to a shoe sole, and more particularly, to a technology which assists in and enables correct walking.

BACKGROUND ART

Although feet can be said to be more important than any other human body parts of the human being who walks upright, many people disregard the importance of feet. Recently, however, the importance of feet and the fact that a correct gait has great influence on the health of the body are becoming increasingly well known.

Accordingly, shoes have been gradually developed to realize specific functions and to be specialized, and expensive shoes have been placed on the market.

Many people have an abnormal gait because of a congenital or postnatal reason. For example, some people have an out-toed gait or a gait which is inclined inward or outward.

Such an abnormal gait will worsen as time passes, and it is apparent that the abnormal gait has an adverse effect on the health.

As a related art, the technology disclosed in Korean Patent Application Publication No. 2009-0113473 was proposed, and FIG. 1 shows a perspective view thereof.

As shown in the figure, according to the related art, a sole 100 has a groove 101, and a coupling member 200 is divided into three sections which have different values of hardness. The coupling member 200 is characterized by being divided in the longitudinal direction. The coupling member 200 consists of three members having different values of hardness, i.e. a first member 201, a second member 202 and a third member 203.

However, according to the related art, since the three members having different values of hardness are attached on the same plane, the object of dispersing the load or making the distribution of pressure uniform cannot be sufficiently completed, which is problematic.

DISCLOSURE

Technical Problem

Accordingly, the present invention has been made keeping in mind the above problems occurring in the related art, and is intended to provide a shoe sole which can effectively improve an abducted or adducted gait with a configuration in which a main midsole has a slope, a first extending section and a second extending section rather than having a flat shape, a lower midsole is positioned on the undersurfaces of the second extending section and the slope, and an upper midsole is coupled to the upper surfaces of the first extending section and the slope.

Technical Solution

In an aspect, the present invention provides a shoe sole that includes an outsole; a main midsole comprising an inclined slope, a first extending section which is connected to the lower end of the slope, and a second extending section which is connected to the upper end of the slope, the first extending section being coupled to the outsole from a periphery of either an inward side or an outward side of an upper surface of the outsole; a lower midsole disposed between undersurfaces of the slope and the second extending section and the upper surface of the outside; and an upper midsole coupled to upper surfaces of the slope and the first extending section.

The shoe sole of the present invention is characterized in that the main midsole has a shank having a similar shape therein.

The shoe sole of the present invention is characterized in that the main midsole has higher hardness than the lower midsole and the upper midsole.

The shoe sole of the present invention is characterized in that the lower midsole and the upper midsole have different values of hardness.

The shoe sole of the present invention is characterized in that the shank extends from a rear foot region to a middle foot region.

Advantageous Effects

The shoe sole according to the present invention has a characteristic structure that can promote a correct gait by preventing load from being concentrated during abducted or adducted walking.

BEST MODE

Figure 1:
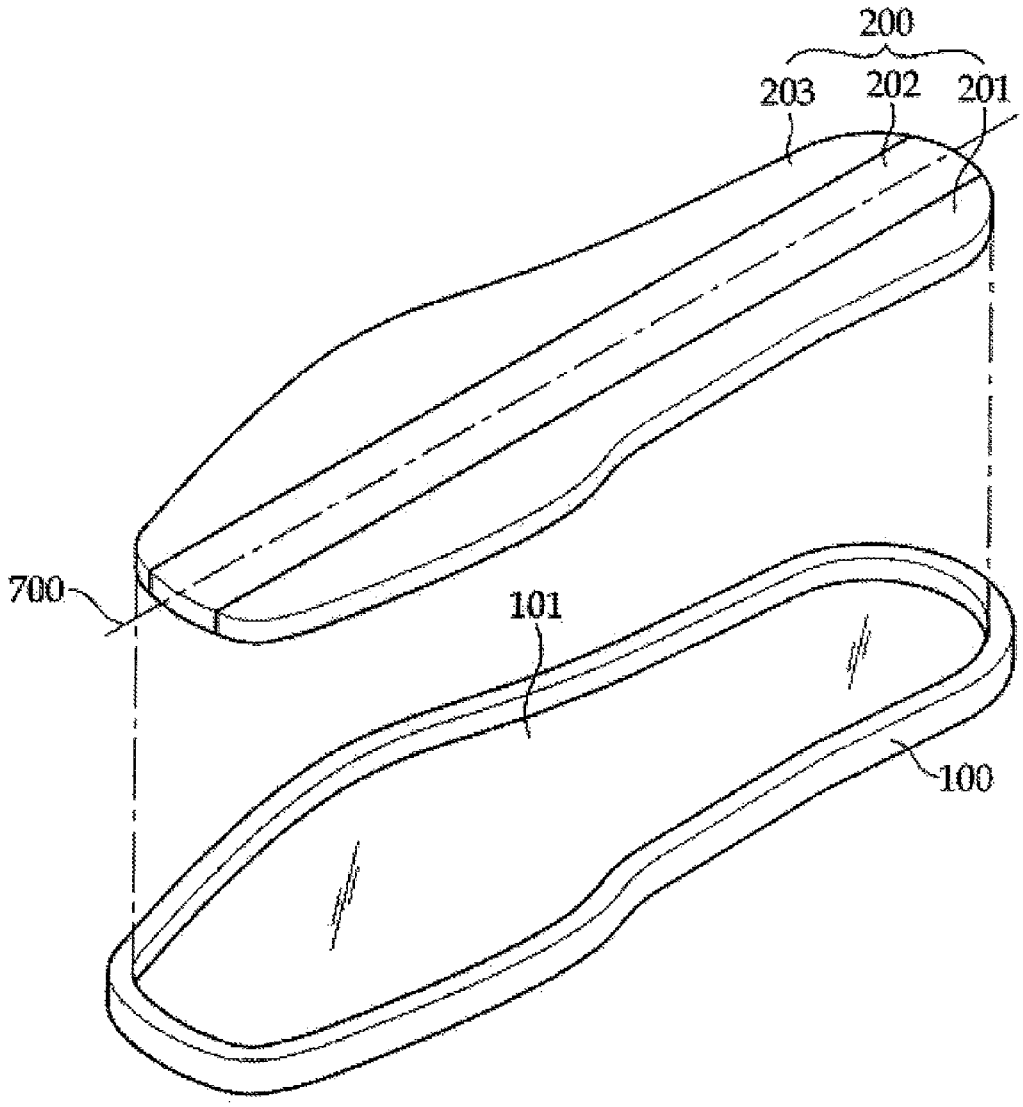
FIG. 1 is a perspective view of the related art.

Reference will now be made in detail to various embodiments of the present invention, examples of which are illustrated in the accompanying drawings and described below, so that a person having ordinary skill in the art to which the present invention relates can easily put the present invention into practice. The present invention, however, can be embodied in various different forms and are not limited to embodiments which will be described hereinafter. In addition, those parts which are not related to the description are omitted from the accompanying drawings in order to more clarify the description of the present invention, and the same reference numerals and signs are used throughout the specification in order to designate the same or similar components.

Unless explicitly stated to the contrary, the word "comprise," "comprises" or "comprising" used throughout the specification will not be understood as the exclusion of the other elements but to imply the inclusion of the other elements.

A shoe sole according to the present invention includes an outsole, a main midsole, a lower midsole and an upper midsole. The main midsole includes a slope which is inclined at a predetermined angle, a first extending section which is connected to the lower end of the slope, and a second extending section which is connected to the upper end of the slope section. The first extending section is directly coupled to the upper surface of the outsole, whereas the second extending section and the slope section are spaced apart from the upper surface of the outsole.

In this configuration, the lower midsole is disposed in the space between and coupled to the undersurfaces of the slope and the second extending section of the main midsole and the upper surface of the outsole, and the upper midsole is coupled to the upper surfaces of the slope and the first extending section.

When the main midsole is coupled to the upper surface of the outsole, the outsole of the first extending section can be coupled in the direction from the inward side or the outward side. The main midsole is rigid and has higher hardness than the lower midsole and the upper midsole. Therefore, owing to the second extending section and the slope which are spaced apart from the upper surface of the outsole, when load is applied, the second extending section exhibits better upward repulsive force than the first extending section.

With these characteristics, it is possible to effectively improve a gait which would otherwise be inclined inward or outward by correcting it, thereby promoting a correct gait.

Figure 2:
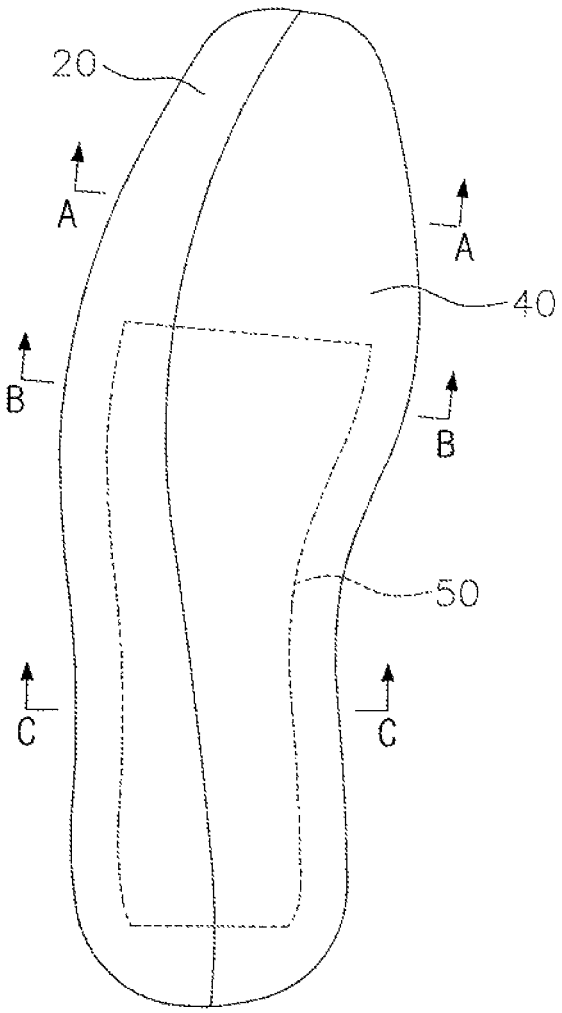
FIG. 2 is a top plan view showing a shoe sole according to a first embodiment of the present invention.
Figure 3:
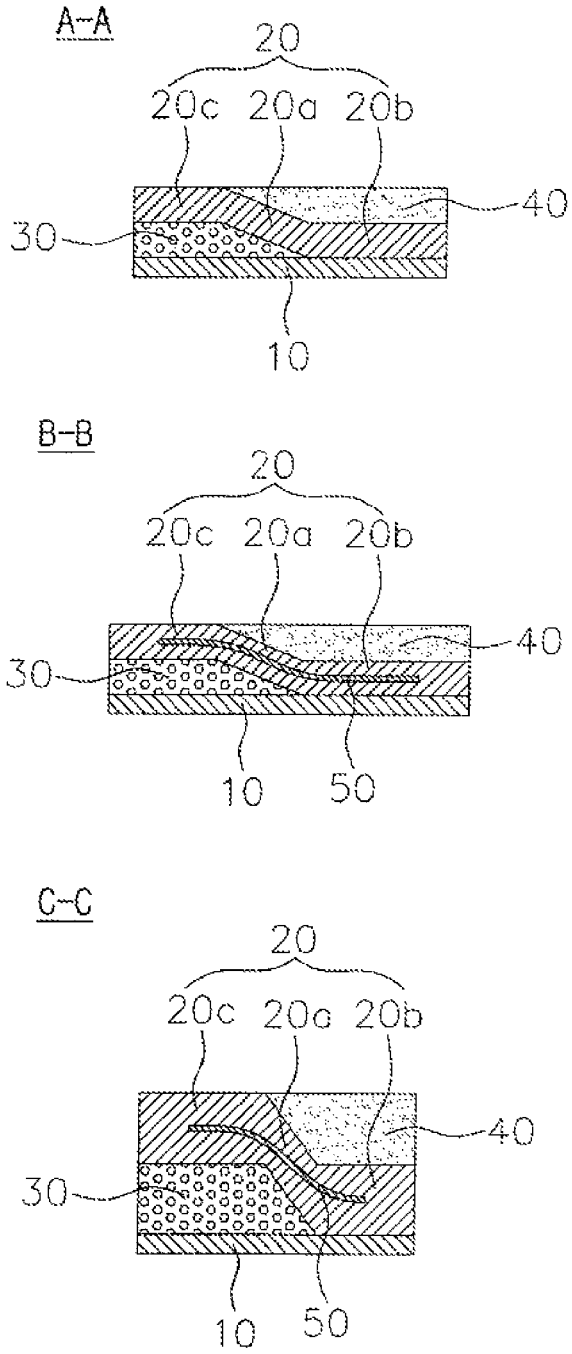
FIG. 3 is a cross-sectional view of the key parts of the shoe sole shown in FIG. 2.

A more specific description will be given of an embodiment. FIG. 2 is a top plan view showing a shoe sole according to a first embodiment of the present invention, and FIG. 3 is a cross-sectional view of the key parts of the shoe sole shown in FIG. 2.

As shown in the figures, a typical outsole 10 is provided, and a main midsole 20, a lower midsole 30 and an upper midsole 40 are disposed over the outsole 10. The main midsole 20 is divided into a slope 20*a*, a first extending section 20*b* and a second extending section 20*c*. The first extending section is connected to the lower end of the slope 20*a*, and the second extending section 20*c* having the shape of a flat plate is connected to the upper end of the slope 20*a*.

Specifically, the first extending section 20*b* and the second extending section 20*c* are formed on both of the left and right ends of the slope 20*a*, and the second extending section 20*c* is positioned higher than the first extending section 20*b*. The main midsole 20 is coupled to the upper surface of the outsole 10, and in particular, the undersurface of the first extending section 20*b* adjoins and is coupled to the upper surface of the outsole 10. The undersurfaces of the second extending section 20*c* and the slope 20*a* are distanced from the upper surface of the outsole 10, thereby leaving a space in which the lower midsole 30 is disposed.

According to this embodiment of the present invention, the first extending section 20*b* is coupled to the upper surface of the outsole 10 starting from the inward side. However, it can be configured such that the first extending section 20*b* is coupled to the upper surface of the outsole 10 starting from the outward side. It is optional whether the first extending section 20*b* of the main midsole 20 is coupled to the inward side or outward side of the upper surface of the outsole 10. Two types can be selectively provided depending on the walking habits of a user.

In other words, it will be suitable that the first extending section 20*b* be coupled to the upper surface of the outsole 10 at the inward side for a person having an abducted gait that is offset outward when walking. In contrast, for a person having an adducted gait that is offset inward when walking (generally, an in-toed gait), it will be suitable for the shoe sole that the first extending section 20*b* is coupled to the upper surface of the outsole 10 at the outward side.

According to this embodiment of the present invention, in the main midsole 20, only the first extending section 20*b* is fixed to the upper surface of the outsole 10, and the slope 20*a* and the second extending section 20*c* are spaced apart from the upper surface of the outsole 10. In this way, the main midsole 20 forms a type of cantilever in which the first extending section 20*b* forms a fixed end and the second extending section 20*c* forms a free end.

Also, in the configuration of the shoe sole according to the present invention, it is more preferred that a shank 50 be disposed inside the main midsole 20, with the shank 50 having an inclined S shape like the shape of the main midsole 20. The shank 50 is made of a metal or a synthetic resin material, and is disposed inside the main midsole 20, thereby forming the skeleton of the main midsole 20 and increasing the elastic resilience of the second extending section 20*c*.

A hollow space is defined between the undersurfaces of the slope 20*a* and the second extending section 20*c* of the main midsole 20 and the upper surface of the outsole 10, and the lower midsole 30 is disposed in this space. As shown in the figures, the lower midsole 30 is coupled to the upper surface of the outsole 10 at the outward side, and the inner end thereof which adjoins the undersurface of the slope section 20*a* is formed as an inclined surface. The lower midsole 30 supports load that is transferred from above via the second extending section 20*c* and the slope 20*a* between the outsole 10 and the second extending section 20*c* and between the outsole 10 and the slope 20*a*.

In addition, the upper midsole 40 is coupled to the upper surfaces of the slope 20*a* and the first extending section 20*b*. The inner cross-section of the upper midsole 40 which adjoins the upper surface of the slope 20*a* is configured as an inclined surface.

In the shoe sole according to an exemplary embodiment of the present invention, it is preferred that the main midsole 20, the lower midsole 30 and the upper midsole 40 be formed with different values of hardness, with the hardness of the main midsole 20 being the highest. In addition, the hardness of the lower midsole 30 may be set to be the same as or different from that of the upper midsole 40.

According to this embodiment, the hardness of the main midsole 20 is set to be the highest, the hardness of the lower midsole 30 is set to be the second highest, and the hardness of the upper midsole 40 is set to be the lowest. Consequently, when load is applied from above, the soft upper midsole 40 is compressed to the greatest amount, and is inclined inward rather than outward. Accordingly, when a person having an abducted gait uses the sole, it is possible to correct undesirable walking habits. It is preferred that the lower midsole 30 be made of a material having an excellent resilient characteristic. It is suitable for the upper midsole 40 to be made of a material that has an excellent shock absorbing characteristic.

It is more preferred that the shank 50 extend from the rear foot region to the middle foot region of a foot rather than the entire area of the main mid sole 20. A foot can be divided into a rear foot region, a middle foot region and a front foot region. The front foot region refers to a region that spans substantially from phalanges to toes. Because toe regions are folded when leaping or jumping, the front foot section of the shoe sole must also be flexible. Therefore, the shank 50 is provided in the area which extends from the rear foot section to the middle foot section.

As described above, the shoe sole of the present invention can be provided as a sole for a shoe which is intended to correct the walking of people who have an abducted gait or an adducted gait which is beyond the range of normal walking. The hardness of the main midsole, the lower midsole, the upper midsole and the shank or the materials used for these components can also be varied in order to provide a shoe sole which can help people who have a normal gait to maintain the correct gait.

The foregoing description of the present invention has been presented for the purposes of illustration and description. It is apparent to a person having ordinary skill in the art to which the present invention relates that the present invention can be easily modified into other detailed forms without changing the technical principle or essential features of the present invention.

Therefore, the foregoing embodiments should be regarded as illustrative rather than limiting in all aspects. In an example, each component which has been described as a unitary part can be implemented as distributed parts. Likewise, each component which has been described as distributed parts can also be implemented as a combined part.

The scope of the present invention is presented by the accompanying Claims rather than the foregoing description. It should be understood that all changes or modifications derived from the definitions and scopes of the Claims and their equivalents fall within the scope of the present invention.

INDUSTRIAL APPLICABILITY

The shoe sole of the present invention can be provided as a sole for a shoe which is intended to correct a gait.

The invention claimed is:

1. A shoe sole comprising:

an outsole;

a main midsole comprising an inclined slope, a first extending section which is connected to a lower end of the slope, and a second extending section which is connected to an upper end of the slope, the first extending section being coupled to the outsole from a periphery of either an inward side or an outward side of an upper surface of the outsole;

a lower midsole disposed between undersurfaces of the slope and the second extending section and the upper surface of the outsole; and an upper midsole coupled to upper surfaces of the slope and the first extending section.

2. The shoe sole of claim 1, wherein the main midsole comprises a shank having a similar shape therein.

3. The shoe sole of claim 1, wherein the main midsole has higher hardness than the lower midsole and the upper midsole.

4. The shoe sole of claim 3, wherein the lower midsole and the upper midsole have different values of hardness.

5. The shoe sole of claim 2, wherein the shank extends from a rear foot region to a middle foot region.

6. The shoe sole of claim 2, wherein the main midsole has higher hardness than the lower midsole and the upper midsole.

* * * * *